United States Patent [19]

Taylor et al.

[11] Patent Number: 4,483,459

[45] Date of Patent: Nov. 20, 1984

[54] DISPENSING MACHINE

[75] Inventors: Michael Taylor, Lower Norton; Malcolm D. N. Withnall, Morton Morrell; Michael A. Talbot, High Wycombe, all of England

[73] Assignee: Mars Limited, London, England

[21] Appl. No.: 400,612

[22] Filed: Jul. 22, 1982

[30] Foreign Application Priority Data

Jul. 24, 1981 [GB] United Kingdom ..... 8122996

[51] Int. Cl.[3] ..... G07F 11/00

[52] U.S. Cl. ..... 221/14; 221/130; 221/192; 221/129

[58] Field of Search ..... 221/14, 123, 126–130, 221/133, 192, 191

[56] References Cited

U.S. PATENT DOCUMENTS

| | | | |
|---|---|---|---|
| 2,321,642 | 6/1943 | Anthony | 221/126 |
| 2,855,740 | 10/1958 | Noland et al. | 221/14 |
| 3,193,138 | 7/1965 | Cox et al. | 221/129 |
| 3,294,282 | 12/1966 | Brown | 221/129 |
| 3,390,754 | 7/1968 | Newberry | 221/129 |
| 3,608,777 | 9/1971 | Bodoh et al. | 221/129 |

*Primary Examiner*—H. Grant Skaggs

*Attorney, Agent, or Firm*—Curtis, Morris & Safford

[57] ABSTRACT

A dispensing machine particularly for dispensing bottles or cans. The machine has a storage area formed by a plurality of parallel vertically spaced inclined shelves and at the lower end of each shelf is a pick-up station. A carrier mounted on a carriage moves vertically past the pick-up stations and can receive a bottle from any selected one by operating a release mechanism when it is adjacent the required pick-up station. The carriage takes the selected bottle to a dispensing station at the top of the machine where the carriage tips and rolls the bottle into a fixed position from which it can be removed by a customer.

14 Claims, 6 Drawing Figures

DISPENSING MACHINE

The present invention relates to a dispensing machine and in particular to a machine for dispensing generally cylindrical articles such as bottles or cans of drink.

In known bottle dispensing machines there is usually provided a magazine for storing the bottles and some form of transport mechanism for transferring a selected bottle to a delivery position on the machine. This transport mechanism is normally gravity operated resulting in the delivery position having to be located at or near the lower part of the machine. Such an arrangement is inconvenient to use, especially if the bottle dispensing machine forms the lower part of a larger vending machine.

According to one aspect of the present invention we provide a dispensing machine for dispensing selected articles wherein an article carrier capable of supporting one or more of the articles is mounted on a carriage, the carriage being moveable vertically to a delivery station.

Preferably, the article carrier is pivotally mounted on the carriage and means are provided at the delivery station to pivot the article carrier and thereby tip the article or articles supported thereon into a fixed delivery position.

Advantageously, a fixed stop at the delivery station extends outwards so that an edge of the article carrier abuts the stop when at the delivery station, further vertical movement of the carriage thereby causing the article carrier to pivot towards the delivery position.

Preferably, the machine includes article storage means capable of feeding articles to one or more pick-up stations arranged vertically below the delivery station and release means at each pick-up station selectively operable to release a predetermined number of articles onto the article carrier when the carriage is at the pick-up station.

Advantageously, the release means comprises a movable stop at each pick-up station actuable by actuator means mounted on the carriage.

Preferably, each pick-up station has sensor means for sensing the presence or absence of an article at the pick-up station and control signal generating means responsive to the presence of the carriage at the pick-up station and to the state of the sensor means.

Advantageously, the machine includes a control circuit responsive to control signals determined by the vertical position of the carriage and control signals from customer operated selector means whereby to dispense selected articles from predetermined pick-up stations.

A dispensing machine constructed in accordance with the present invention will now be described by way of example and with reference to the accompanying drawings in which.

Figure 4:
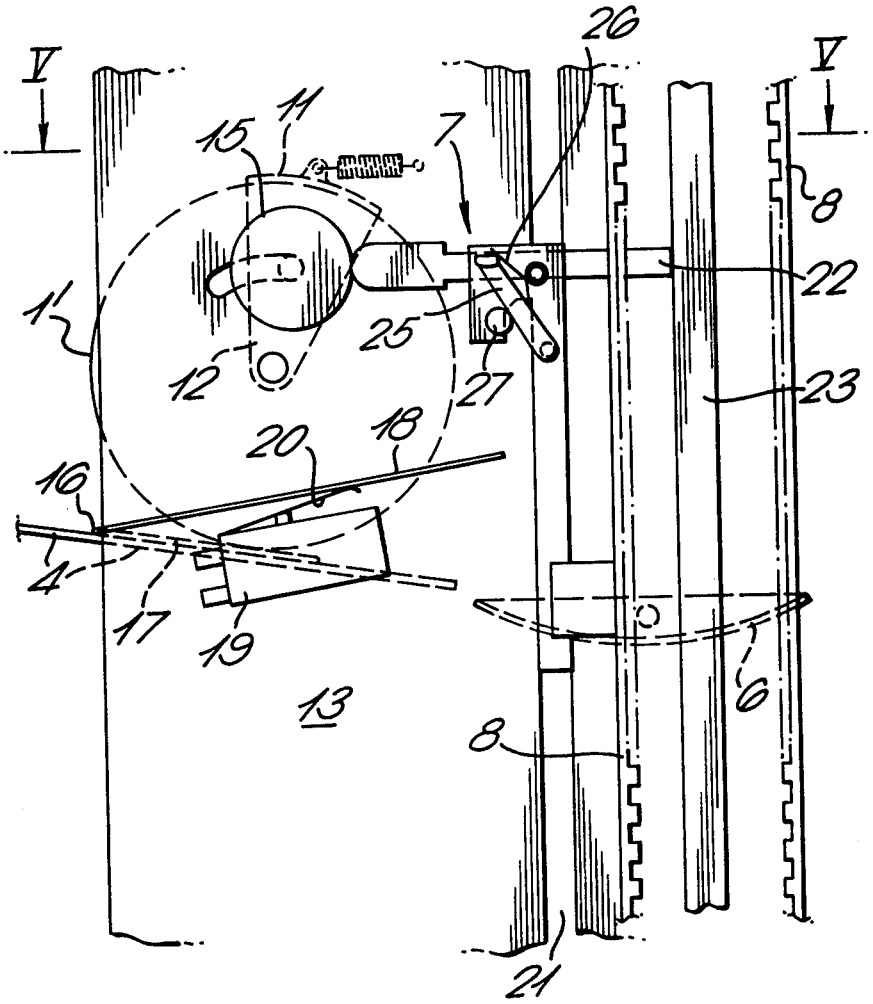
FIG. 4 is an enlarged view of part of FIG. 2.
Figure 4A:
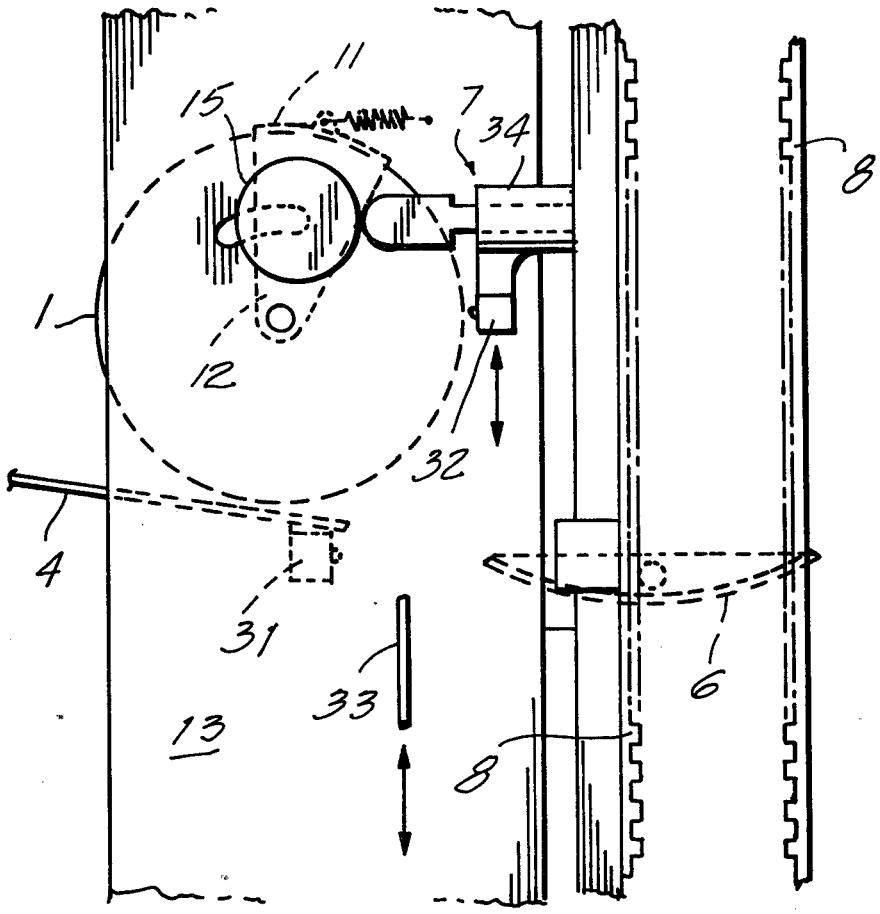

FIG. 4*a* is an alternative embodiment of the present invention; and

Figure 5:
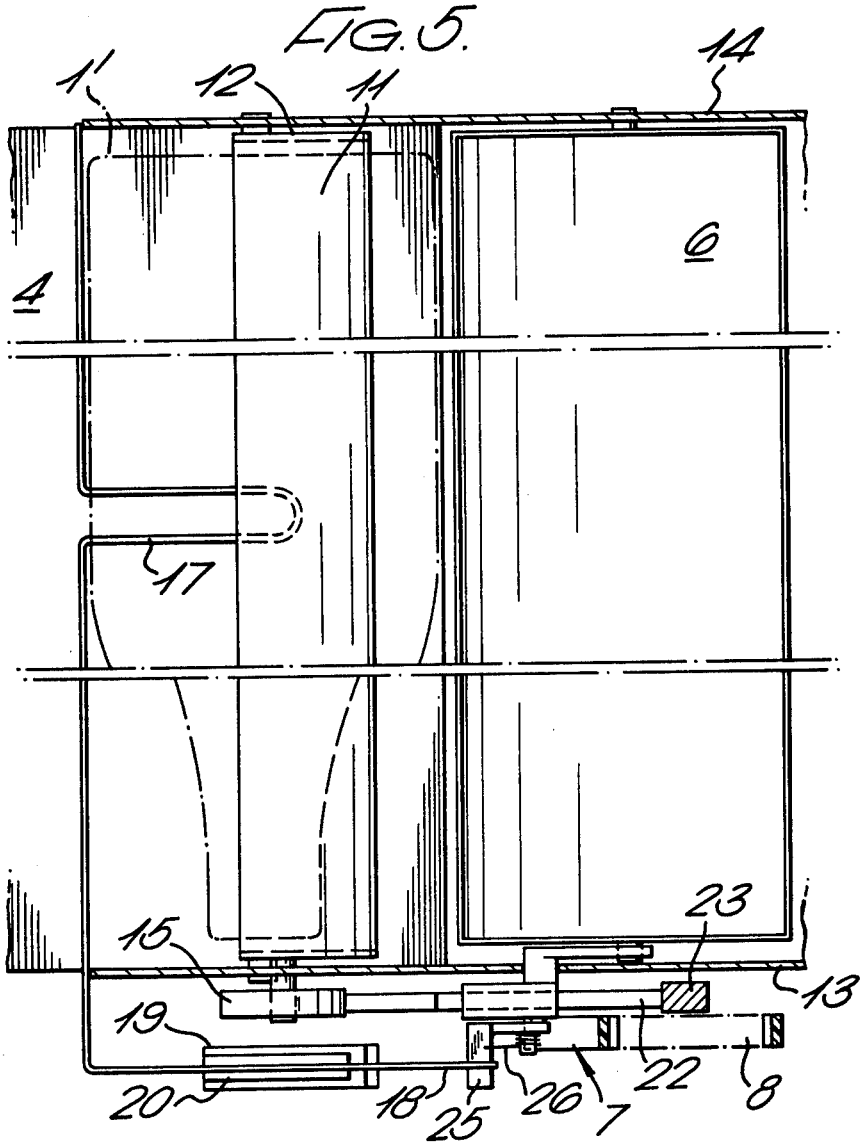

FIG. 5 is a section through FIG. 4 taken on line V—V.

Figure 1:
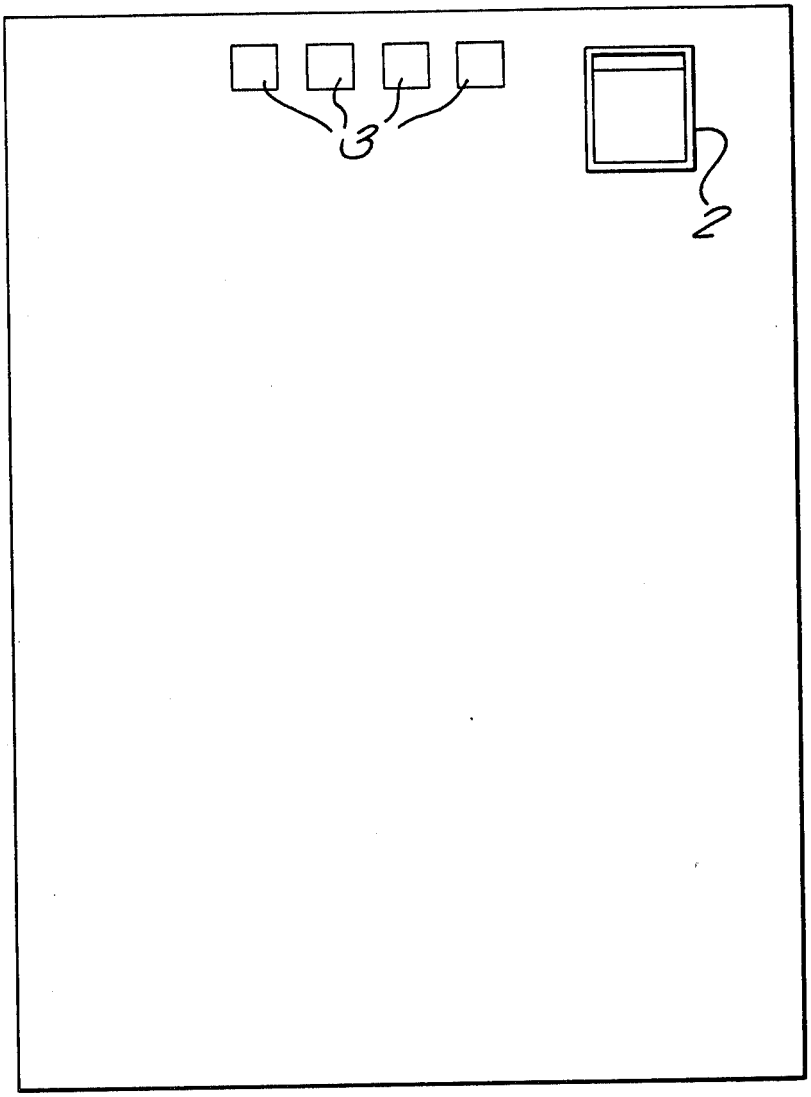
FIG. 1 is a front elevation of the machine.
Figure 2:
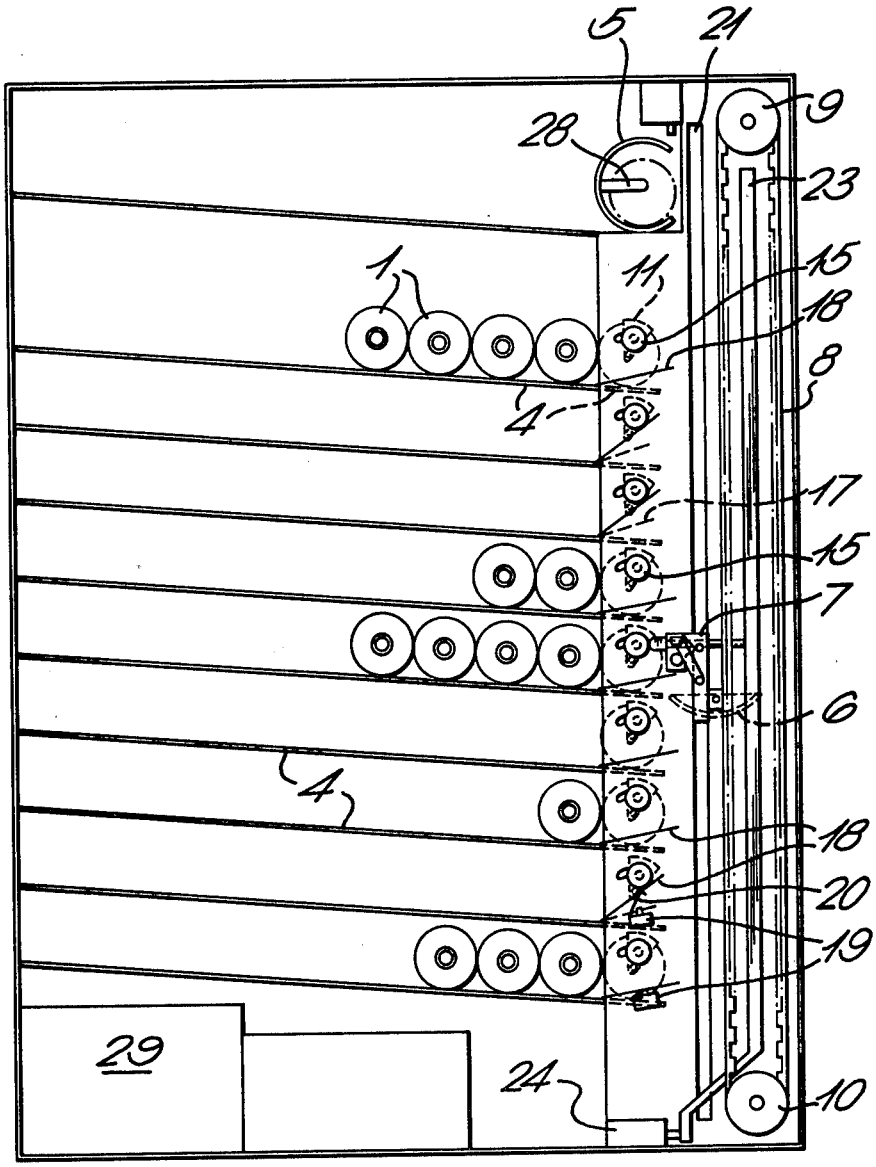
FIG. 2 is a front elevation as in FIG. 1 but with the front panel removed.
Figure 3:
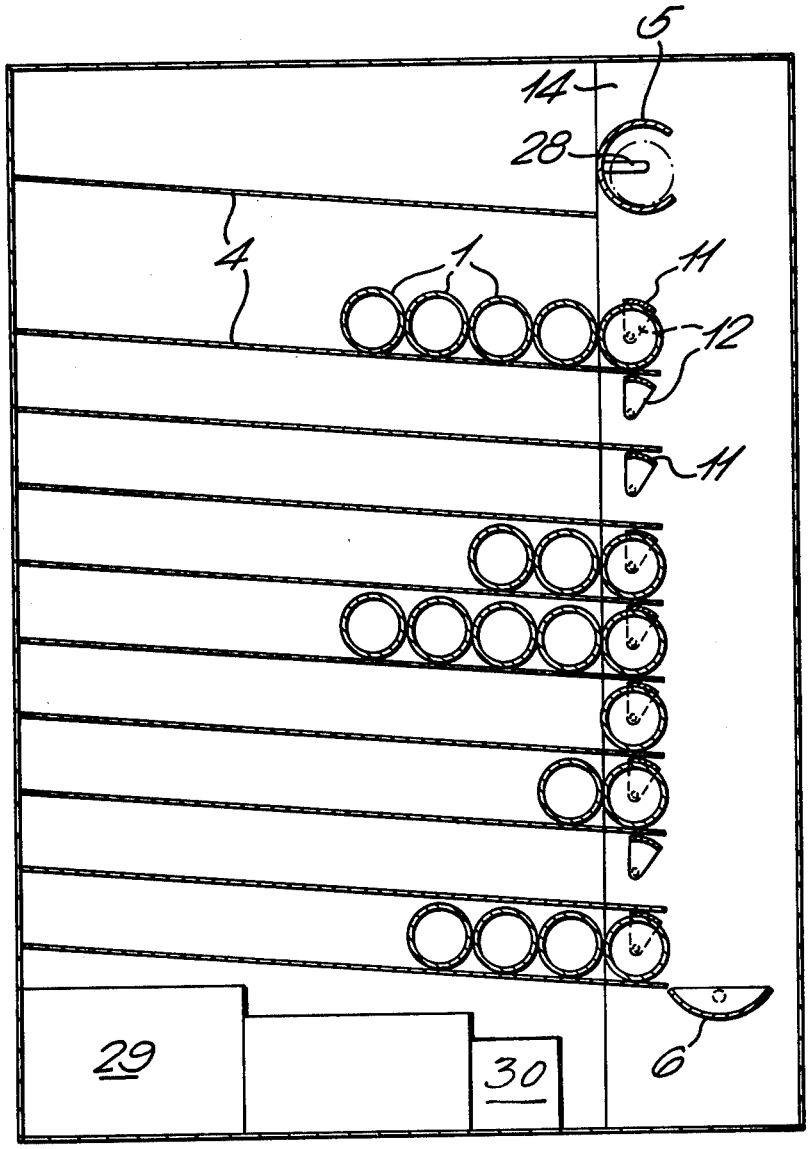
FIG. 3 is a section through the machine.

Referring to FIGS. 1 to 3 the dispensing machine is intended for dispensing generally cylindrical articles such as bottles of drink 1. The bottles are stored in a magazine inside the machine and are dispensed one at a time through a port 2 when the appropriate one of the selection buttons 3 on the front of the machine is pressed. A conventional coin operated mechanism may be linked to the selection buttons to receive appropriate payment for each bottle, although this is not shown in FIG. 1, and the machine may form part of a larger dispensing machine, in which case the selection buttons may more conveniently be provided on a different part of the machine.

As seen in FIGS. 2 and 3 the inside of the machine comprises a plurality of sloping shelves 4 on which the bottles 1 are stored, a cradle 5 positioned behind the port 2 in the front panel of the machine and a bottle carrier 6 on a movable carriage 7. The carriage 7 is secured to a toothed timing belt 8 which runs over a pair of toothed pulleys 9, 10, the lower of which is driven by a DC servo motor so that the carriage can move vertically past pick-up stations at the ends of the shelves to a delivery station at the top of the machine.

On each shelf 4 the end bottle 1 at the pick-up station is prevented from rolling off the shelf by a pivotable stop 11 which in its normal position engages the top of the end bottle just forward of its centre line. The stop 11 is a part cylindrical element of radius slightly greater than the bottle having segment shaped end portions 12, mounted for pivotal movement about its axis of curvature on front and rear support plates 13, 14 (see FIGS. 4 and 5). A stub axle is secured to one end portion 12 and passes through a curved guide slot in the front plate 13 so as to limit the pivotal movement of the stop 11, which is spring urged towards its normal forward position shown in FIGS. 4 and 5. Freely rotatable on the stub axle is a roller 15. When pivoted backwards against the spring bias by pressure on the roller 15, the stop 11 releases the end bottle and engages the next bottle, holding that bottle at the pick-up station when the stop returns to its normal position.

Adjacent the end of each shelf is a bent wire having a pivot portion 16 secured across the shelf and at right angles to the pivot portion a sensor portion 17 and a trigger portion 18. The sensor portion 17 and trigger portion 18 are at an angle to one another so that when the sensor portion is flat against the shelf the trigger portion is inclined upwards. The wire is pivotable about the pivot portion 16. Below the trigger portion which lies outside the front support plate 13 there is secured a microswitch 19 having an actuating arm 20 spring urged against the trigger portion. When there is no bottle at the pick-up station at the end of the shelf, i.e. the shelf is empty, the arm 20 holds the trigger portion of the bent wire up at an angle such that the sensor portion 17 is at an acute angle to the shelf surface. The microswitch contacts are then open. When there is a bottle at the pick-up station at the end of the shelf, the weight of the bottle forces the sensor portion down against the shelf which pivots the trigger portion and arm 20 downwards sufficiently to close the microswitch contacts.

The carriage 7 slides in a vertical slot 21 in the front support plate 13 and has at its upper end a horizontal bore in which actuator means in the form of a pusher bar 22 can freely slide. One end of the pusher bar 22 abuts a vertical actuator bar 23 secured to the front support plate 13 and slidable across the plate towards the carriage 7 when operated by a solenoid 24 at the base of the machine (see FIG. 2). Also at the upper end of the carriage 7 is a lever 25 pivoted on the carriage 7 at its lower end and biased by a spring 26 towards a stop 27. The free end of the lever 25 extends horizontally outwards from the carriage, as shown in FIG. 5, and is positioned so that as the carriage is moved upwards in the slot 21 by the belt 8 the free ends of the trigger portions 18 of the bent wires are contacted successively by the free end of the lever 25. Where a trigger portion is in the position in which the microswitch contacts are closed, i.e. a bottle is at the end of the appropriate shelf, the lever 25 lifts the trigger portion sufficiently to give a momentary opening of the microswitch contacts before the carriage moves on. Control logic 30 connected to the microswitches can thus detect from these pulses when the carriage has reached a shelf with one or more bottles in it.

Supported at the lower end of the carriage 7 is the bottle carrier 6, which is a shallow part-cylindrical element freely pivotable relative to the carriage 7 about a central axis perpendicular to the support plates 13, 14.

Adjacent the top of the machine is a delivery position formed by the cradle 5, which is generally cylindrical shaped, having an opening along one side. The lower edge of the side opening extends outwards slightly to form a stop and is positioned so that the edge of bottle carrier 6, when the carriage approaches the top of the vertical slot 21, abuts it and so causes the bottle carrier to pivot about its axis as the carriage continues upwards. This pivoting will tip a bottle on the bottle carrier 6 into the cradle 5 through the side opening.

At the rear of the cradle 5 is a lever 28 mechanically linked to a shutter closing the port 2. When this shutter is raised to give access to the port, the linkage causes the lever 28 to move forwards and so push the bottle which is in the cradle towards the customer. This allows easy removal of the dispensed bottle.

In use, the carriage 7 is normally at the bottom of the machine as shown in FIG. 3 and the shelves are charged with articles to be dispensed such as bottles of drink. The shelves will have certain predetermined types of drink in a preset pattern. For example the top three shelves could have one type of drink, the next four shelves a second type and the bottom shelf a third type. Control logic circuitry 30 for the machine is programmed with this pattern and the three choices of drink are provided on the selector buttons.

If the second type of drink is selected then the DC motor is actuated and the carriage raised by the belt 8. From the number of rotations of the motor, which determines the position of the belt, the circuitry knows when the carriage has passed the lowest shelf and so is approaching the section containing the required drink. As shown in FIGS. 2 and 3 the section containing the required drink may be partly empty. In this case when the carriage comes to an empty shelf, no pulse is produced by the corresponding microswitch since the trigger portion 18 of the bent wire is in its raised position. However, when the carriage comes to a shelf with one or more bottles in it, the trigger portion will be in its lowered position and a pulse will be produced as the wire is lifted by the lever 25 on the carriage. The pulse causes the control logic circuitry 30 to stop the carriage after a slight delay so that the carriage is positioned as shown in FIGS. 2, 4 and 5.

Once the carriage is stopped a pulse is delivered to the solenoid 24 causing the actuator bar 23 to move across and press the pusher bar 22 against the roller 15. This rotates the stop 11 and releases the end bottle, which rolls onto the carrier 6 positioned adjacent the end of the shelf. After a delay to allow the bottle time to roll off the shelf, the solenoid then returns and the stop 11 rotates back to its normal position holding the next bottle. If there is no next bottle then the sensor portion 17 of the bent wire will rise and the microswitch contacts will open, causing the carriage on its next passage to take a bottle from the shelf above. It is noted that this mechanism depletes the shelves from the bottom of each section upwards, as seen in FIGS. 2 and 3.

With the bottle on the bottle carrier, the motor restarts and the carriage carries the bottle upwards. As the carriage reaches the delivery station at the top of the machine, the bottle carrier abuts the protruding lower edge of the side opening into the cradle 5 and continued movement of the carriage causes the bottle to be tipped into the cradle. The carriage then engages a switch at the top of the machine and the motor is reversed returning the carriage to its normal position at the bottom of the machine. On its return passage the lever 24 does not damage the free ends of the bent wires which protrude into its path since it can pivot out of their way against the spring 26.

The bottle is now removed from the machine by raising the shutter on the port 2 which, as explained above, causes the lever 28 to push the bottle out towards the customer.

In an alternative embodiment illustrated in FIG. *4a*, the bent wires and microswitches are replaced by light emitting diodes (LEDs) 31. One LED 31 is positioned at the end of each shelf and a photodetector 32 on the carriage detects when the carriage reaches a shelf. A shutter 33 is positioned to be operated by the end bottle on the shelf so that when the last bottle has been dispensed the shutter 33 obscures the LED 31 for that shelf. The carriage will stop at the first shelf in the required section which has an unobscured LED.

A further modification is to replace the pusher bar 22 by a small solenoid 34 actuated instead of the solenoid 24. This eliminates the need for the actuator bar 23 and its associated mechanical linkages.

While the dispensing machine has been described for use with bottles of drink it can be used with any other suitable articles provided they can be stacked in the sloping shelves and will roll onto and off the carrier. For dispensing cold drinks a refrigerator compressor unit 29 is disposed in the cabinet with a cooling plate on the back wall.

In a modified version to the apparatus as already described and illustrated, the stops 11 are normally disposed in a position approximately 150° clockwise from the position shown in FIG. 4. As such, each stop is adjacent its respective shelf 4 and acts as a block preventing the bottles rolling off the shelf. To dispense a bottle, the stop 11 is urged underneath the relevant bottle resting on the shelf to a position approximately 210° clockwise from that shown in FIG. 4. The bottle then rolls off the shelf onto the carrier 6 as already described. Each stop 11 is biassed to its normal position by a spring sufficiently strong such that, once a bottle has been dispensed, the stop 11 snaps back to the normal position faster than the remaining bottles roll down the shelf. In this manner only one bottle is dispensed at a time and jamming does not occur.

In place of a pusher bar 22 supported for movement by carriage 7, each stop 11 is provided with its own individual pusher bar which extends outwardly towards actuator bar 23. The solenoid 24 provides a twisting, rotary motion to actuator bar 23 rather than a horizontal sideways motion as in the illustrated embodiment.

The carriage 7 is supported for vertical movement on the actuator bar 23 (which is of square cross-section) rather than being carried in slot 21. When a bottle is to be dispensed, and with the carriage correctly located adjacent the relevant shelf 4, a projection of the carriage abuts the end of the pusher bar of the relevant stop 11. The rotary motion of actuator bar 23 causes the carriage projection to urge the pusher bar in a direction towards the bottle to be dispensed. This causes the stop 11 to pass under the bottle, which then rolls onto the bottle carrier 6.

The bottle carrier 6 and carriage 7 are normally located, in the start position, at the top of the extent of travel on actuator bar 23, adjacent cradle 5. To dispense a bottle, the carriage descends to the first of the shelves 4 which carries a supply of the bottles in question. The carrier 6 receives its bottle and then ascends to deposit it in the cradle 5 as described. This arrangement is preferred for security reasons since at the top, start position, the carrier 6 acts as an obstruction against pilferage of bottles via access through the port 2.

We claim:

1. A dispensing machine for dispensing selected articles comprising:

an article storage means having a plurality of vertically-spaced parallel-inclined shelves each capable of feeding articles to a pick-up station at the lower end of the shelf, said pick-up stations being arranged vertically;

an article carrier capable of supporting one or more articles;

a carriage movable vertically past each of said pick-up stations to a delivery station, said article carrier being mounted on said carriage;

a movable stop at each pick-up station selectively operable to release an article onto the article carrier when the carriage is adjacent a pick-up station;

actuator means mounted on the carriage for actuating a selected movable stop; and means for moving the carriage vertically, for causing it to stop adjacent a pick-up station from which an article is to be taken, for actuating the actuator means whereby the article is released onto the article carrier, and for continuing movement of the carriage to place the article at the dispensing station.

2. A dispensing machine according to claim 1, wherein the article carrier is pivotally mounted on the carriage and tipping means are provided at the delivery station to pivot the article carrier and thereby tip the article or articles supported thereon into a fixed delivery position.

3. A dispensing machine according to claim 2, wherein the tipping means comprise a fixed stop at the delivery station which extends outwards so that an edge of the article carrier abuts the stop when at the delivery station, further vertical movement of the carriage thereby causing the article carrier to pivot towards the delivery position.

4. A dispensing machine according to claim 1, wherein each movable stop is a segment of a hollow cylinder pivotable about its longitudinal axis and spring urged into a position in which it prevents movement of articles out of the pick-up station, the actuator means causing the movable stop to pivot into a position in which the end article at the pick-up station is released.

5. A dispensing machine according to claim 1 wherein each pick-up station has sensor means for sensing the presence or absence of an article at the pick-up station and control signal generating means responsive to the presence of the carriage adjacent the pick-up station and to the state of the sensor means, whereby to generate a signal for inhibiting operation of the release means when no article is present at the pick-up station.

6. A dispensing machine according to claim 5, wherein each pick-up station has a light emitting device positioned adjacent the path of movement of the carriage and the control signal generating means comprises a light sensitive device mounted on the carriage which is sensitive to the light emitting devices, the sensor means being arranged to prevent passage of light from the light emitting device to the light sensitive device when there is no article at the pick-up station.

7. A dispensing machine according to claims 4, 5 or 6, having a control circuit responsive to control signals determined by the vertical position of the carriage and control signals from customer operated selector means, whereby to dispense selected articles from predetermined pick-up stations.

8. A dispensing machine according to claim 1 wherein said actuator means comprises a bar carried by and slidable relative to the carriage, and wherein means are provided for causing relative movement between the bar and the carriage to enable the bar to engage the selected movable stop.

9. A dispensing machine according to claim 8 wherein said actuator means comprises a solenoid on said carriage.

10. A dispensing machine for dispensing selected articles comprising:

an article storage means having a plurality of vertically-spaced parallel-inclined shelves each capable of feeding articles to a pick-up station at the lower end of the shelf, said pick-up stations being arranged vertically;

an article carrier capable of supporting one or more articles;

a carriage movable vertically past each of said pick-up stations to a delivery station, said article carrier being mounted on said carriage;

a movable stop at each pick-up station selectively operable to release an article onto the article carrier when the carriage is adjacent a pick-up station;

actuator means mounted on the carriage for actuating a selected movable stop; and means for moving the carriage vertically, for causing it to stop adjacent a pick-up station from which an article is to be taken, for actuating the actuator means whereby the article is released onto the article carrier, and for continuing movement of the carriage to place the article at the dispensing station;

wherein each pick-up station has sensor means for sensing the presence or absence of an article at the pick-up station and control signal generating means responsive to the presence of the carriage adjacent the pick-up station and to the state of the sensor means, whereby to generate a signal for inhibiting operation of the release means when no article is present at the pick-up station; and wherein each sensor means comprises a lever positioned so as to be depressed by an article at the pick-up station and the control signal generating means comprises, at each pick-up station a resilient lever movable with the sensor lever and an electrical switch operable by the resilient lever when the sensor lever is depressed, and on the carriage a stop capable of flexing the resilient lever sufficiently to change the state of the switch when the sensor bar is depressed.

11. A dispensing machine according to claim 10 having a control circuit responsive to control signals determined by the vertical position of the carriage and control signals from customer operated selector means, whereby to dispense selected articles from predetermined pick-up stations.

12. A dispensing machine according to claim 11 wherein a pusher element is provided at the delivery station, the pusher element being operable to engage an article at the delivery station and push it through a delivery port.

13. A dispensing machine according to claim 10 wherein a pusher element is provided at the delivery station, the pusher element being operable to engage an article at the delivery station and push it through a delivery port.

14. A dispensing machine according to claims 1 or 10, wherein a pusher element is provided at the delivery station, the pusher element being operable to engage an article at the delivery station and push it through a delivery port.

* * * * *